US009752531B2

(12) United States Patent
Hayman

(10) Patent No.: US 9,752,531 B2
(45) Date of Patent: Sep. 5, 2017

(54) ENGINE ASSEMBLY INCLUDING COMBUSTION CHAMBERS WITH DIFFERENT PORT ARRANGEMENTS

(75) Inventor: Alan W. Hayman, Romeo, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 1192 days.

(21) Appl. No.: 12/950,269

(22) Filed: Nov. 19, 2010

(65) Prior Publication Data

US 2012/0125282 A1 May 24, 2012

(51) Int. Cl.

| | |
|---|---|
| ***F02F 1/42*** | (2006.01) |
| ***F01N 13/10*** | (2010.01) |
| ***F02B 33/22*** | (2006.01) |
| ***F02M 26/43*** | (2016.01) |
| ***F02M 26/44*** | (2016.01) |
| *F02B 23/10* | (2006.01) |
| *F02B 23/08* | (2006.01) |
| *F02B 75/12* | (2006.01) |
| *F02B 75/18* | (2006.01) |

(52) U.S. Cl.

CPC ..... *F02F 1/4285* (2013.01); *F01N 13/107* (2013.01); *F02B 33/22* (2013.01); *F02M 26/43* (2016.02); *F02M 26/44* (2016.02); *F02B 23/104* (2013.01); *F02B 2023/085* (2013.01); *F02B 2075/125* (2013.01); *F02B 2075/1812* (2013.01)

(58) Field of Classification Search

CPC ..... F02F 1/4285; F01N 13/107; F02B 33/22; F02M 26/43; F02M 26/44

USPC ..... 123/193.5, 568.11, 568.13, 568.17

See application file for complete search history.

(56) References Cited

U.S. PATENT DOCUMENTS 3,924,576 A * 12/1975 Siewert ..... 123/1 R
4,131,095 A 12/1978 Ouchi (Continued)

FOREIGN PATENT DOCUMENTS

DE 3007746 A1 9/1981
DE 69301470 T2 10/1996

(Continued)

OTHER PUBLICATIONS

Hundleby, G.E., "Development of a Poppet-Valved Two-Stroke Engine—The Flagship Concept", Ricardo Consulting Engineers Ltd., SAE International Paper No. 900802, Feb. 1, 1990, 6 pgs.

*Primary Examiner* — Jacob Amick

(74) *Attorney, Agent, or Firm* — Harness, Dickey & Pierce, P.L.C.

(57) ABSTRACT

An engine assembly may include an engine block, a first piston, a second piston, and a cylinder head. The first piston may be located in a first cylinder bore and the second piston may be located in a second cylinder bore. The cylinder head may be coupled to the engine block and cooperate with the first cylinder bore and the first piston to define a first combustion chamber and with the second cylinder bore and the second piston to define a second combustion chamber. The cylinder head may define a first intake and exhaust port arrangement in communication with the first combustion chamber and may define a second intake and exhaust port arrangement in communication with the second combustion chamber. The second intake and exhaust port arrangement may include a greater total number of ports than the first intake and exhaust port arrangement.

8 Claims, 2 Drawing Sheets

(56) References Cited

U.S. PATENT DOCUMENTS

| | | | | |
|---|---|---|---|---|
| 4,506,633 | A * | 3/1985 | Britsch | 123/58.8 |
| 5,217,229 | A | 6/1993 | Jaime | |
| 6,286,467 | B1 | 9/2001 | Ancheta | |
| 6,505,592 | B1 * | 1/2003 | Hayman et al. | 123/90.61 |
| 7,028,648 | B2 | 4/2006 | Hasegawa et al. | |
| 7,036,465 | B2 | 5/2006 | Burk et al. | |
| 7,721,541 | B2 | 5/2010 | Roberts, Jr. et al. | |
| 7,740,003 | B2 | 6/2010 | Rayl | |
| 8,132,546 | B2 | 3/2012 | Surnilla | |
| 8,312,849 | B2 | 11/2012 | Roe et al. | |
| 8,671,920 | B2 | 3/2014 | Hayman et al. | |
| 2006/0112940 | A1 * | 6/2006 | Roberts et al. | 123/568.11 |
| 2008/0201059 | A1 | 8/2008 | Bryant | |
| 2009/0229569 | A1 * | 9/2009 | Glugla et al. | 123/406.2 |
| 2009/0308070 | A1 * | 12/2009 | Alger et al. | 60/602 |
| 2012/0042649 | A1 * | 2/2012 | Kaneko et al. | 60/614 |
| 2012/0048244 | A1 | 3/2012 | Hayman et al. | |

FOREIGN PATENT DOCUMENTS

| | | | |
|---|---|---|---|
| DE | 10239224 | A1 | 4/2003 |
| EP | 1167715 | A2 | 1/2002 |
| WO | 2008031939 | A2 | 3/2008 |

* cited by examiner

ENGINE ASSEMBLY INCLUDING COMBUSTION CHAMBERS WITH DIFFERENT PORT ARRANGEMENTS

FIELD

The present disclosure relates to engine port arrangements.

BACKGROUND

This section provides background information related to the present disclosure which is not necessarily prior art.

Internal combustion engines may combust a mixture of air and fuel in cylinders and thereby produce drive torque. Intake ports direct air flow to the combustion chamber. Combustion of the air-fuel mixture produces exhaust gases. Exhaust ports transport exhaust gases from the combustion chamber.

SUMMARY

An engine assembly may include an engine block, a first piston, a second piston, and a cylinder head. The engine block may define first and second cylinder bores. The first piston may be located in the first cylinder bore and the second piston may be located in the second cylinder bore. The cylinder head may be coupled to the engine block and cooperate with the first cylinder bore and the first piston to define a first combustion chamber and with the second cylinder bore and the second piston to define a second combustion chamber. The cylinder head may define a first intake and exhaust port arrangement in communication with the first combustion chamber and may define a second intake and exhaust port arrangement in communication with the second combustion chamber. The second intake and exhaust port arrangement may include a greater total number of ports than the first intake and exhaust port arrangement.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 2:
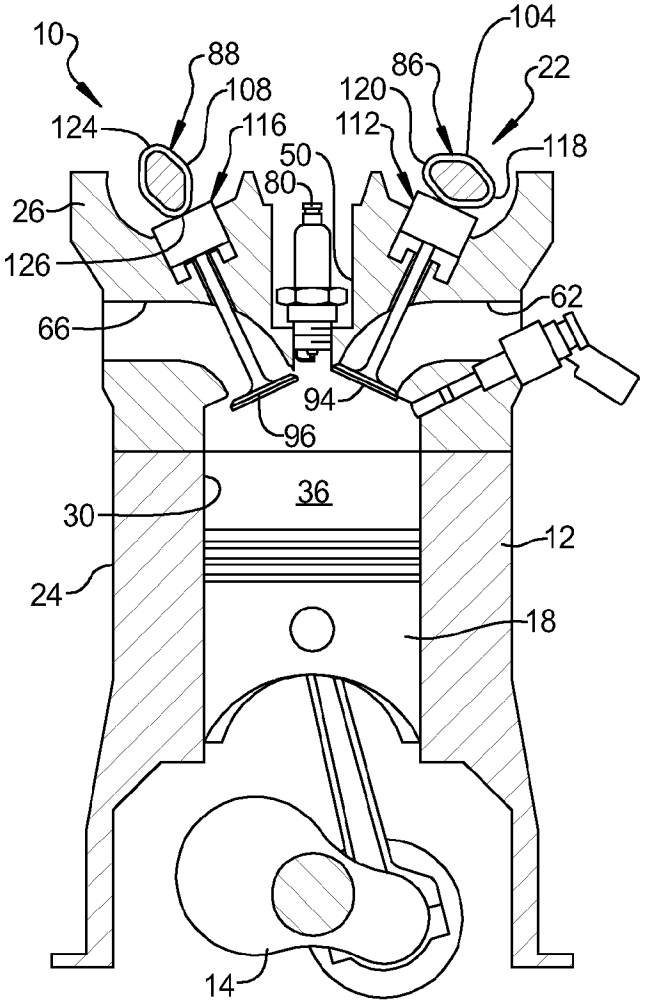
FIG. 2 is an additional section view of the engine assembly of FIG. 1.
Figure 1:
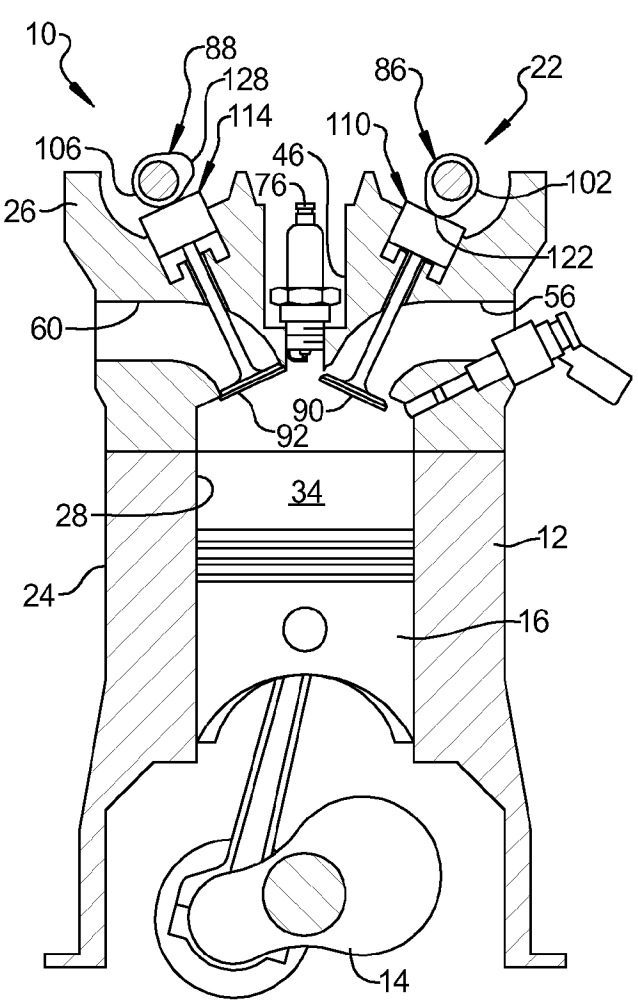
FIG. 1 is a section view of an engine assembly according to the present disclosure.
Figure 3:
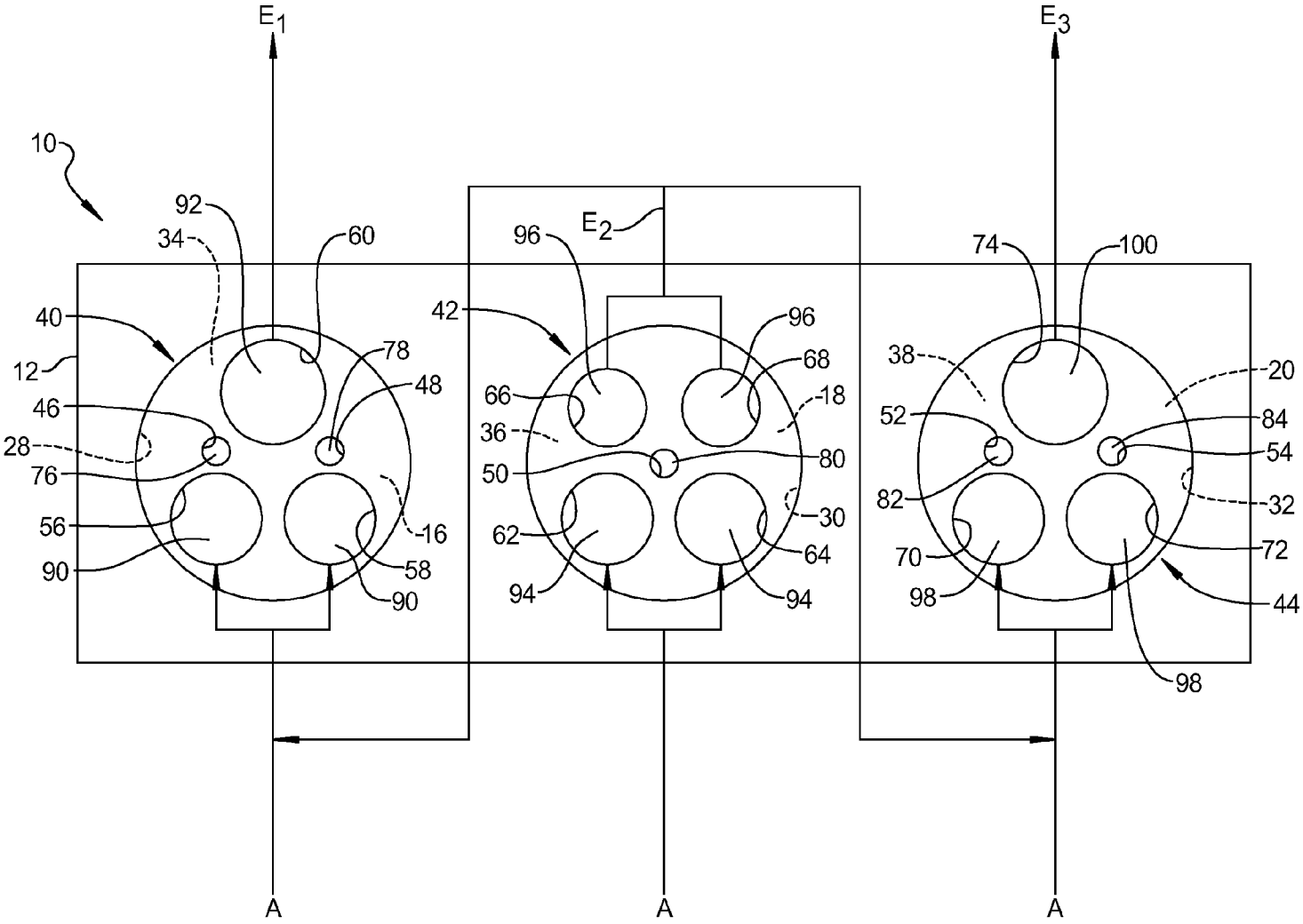
FIG. 3 is a schematic illustration of the engine assembly shown in FIGS. 1 and 2.

An engine assembly 10 is illustrated in FIGS. 1-3 and may include an engine structure 12, a crankshaft 14, first, second and third pistons 16, 18, 20, and a valvetrain assembly 22. The engine structure 12 may include an engine block 24 and a cylinder head 26. The engine structure 12 may define first, second and third cylinder bores 28, 30, 32. The second cylinder bore 30 may be located between the first and third cylinder bores 28, 32 along a longitudinal extent of the engine block 24.

The first piston 16 may be located in the first cylinder bore 28, the second piston 18 may be located in the second cylinder bore 30, and the third piston 20 may be located in the third cylinder bore 32. The cylinder head 26 cooperates with the first cylinder bore 28 and the first piston 16 to define a first combustion chamber 34, cooperates with the second cylinder bore 30 and the second piston 18 to define a second combustion chamber 36, and cooperates with the third cylinder bore 32 and the third piston 20 to define a third combustion chamber 38.

While described in combination with a three cylinder inline engine configuration, it is understood that the present teachings apply to any number of piston-cylinder arrangements and a variety of reciprocating engine configurations including, but not limited to, V-engines, inline engines, and horizontally opposed engines, as well as both overhead cam and cam-in-block configurations. By way of non-limiting example, two of the three cylinder arrangements could be disposed at an angle relative to one another to form a V-6 engine configuration. Alternatively, an additional cylinder could be added to form an inline four cylinder arrangement.

The cylinder head 26 may define a first intake and exhaust port arrangement 40 in communication with the first combustion chamber 34, a second intake and exhaust port arrangement 42 in communication with the second combustion chamber 36, a third intake and exhaust port arrangement 44 in communication with the third combustion chamber 38, first and second spark plug openings 46, 48 for the first combustion chamber 34, a single spark plug opening 50 for the second combustion chamber 36, and first and second spark plug openings 52, 54 for the third combustion chamber 38. The second intake and exhaust port arrangement 42 may be located between the first and third intake and exhaust port arrangements 40, 44 along a longitudinal extent of the cylinder head 26.

The first intake and exhaust port arrangement 40 may provide air flow (A) to the first combustion chamber 34 and transport exhaust gas flow ($E_1$) from the first combustion chamber 34. The second intake and exhaust port arrangement 42 may provide air flow (A) to the second combustion chamber 36 and transport exhaust gas flow ($E_2$) from the second combustion chamber 36. The third intake and exhaust port arrangement 44 may provide air flow (A) to the third combustion chamber 38 and transport exhaust gas flow ($E_3$) from the third combustion chamber 38.

The second intake and exhaust port arrangement 42 may include a greater total number of ports than the first intake and exhaust port arrangement 40 and a greater total number of ports than the third intake and exhaust port arrangement 44. The first intake and exhaust port arrangement 40 may include first and second intake ports 56, 58 and a single exhaust port 60. The second intake and exhaust port arrangement 42 may include first and second intake ports 62, 64 and first and second exhaust ports 66, 68. The third intake and exhaust port arrangement 44 may include first and second intake ports 70, 72 and a single exhaust port 74. Therefore, the second intake and exhaust port arrangement 42 may include a greater number of exhaust ports than the first intake and exhaust port arrangement 40 and a greater number of exhaust ports than the third intake and exhaust port arrangement 44.

The first exhaust port 62 of the second intake and exhaust port arrangement 42 may be in communication with the first combustion chamber 34 and may provide exhaust gas ($E_2$) from the second combustion chamber 36 to the first combustion chamber 34. The second exhaust port 68 of the second intake and exhaust port arrangement 42 may also be in communication with the first combustion chamber 34 and may provide exhaust gas ($E_2$) from the second combustion chamber 36 to the first combustion chamber 34. The first and second exhaust ports 66, 68 of the second intake and exhaust port arrangement 42 may additionally be in communication with the third combustion chamber 38 and may provide exhaust gas ($E_2$) from the second combustion chamber 36 to the third combustion chamber 38.

The engine assembly 10 may include first and second spark plugs 76, 78 located in the first and second spark plug openings 46, 48 associated with the first combustion chamber 34, a single spark plug 80 located in the single spark plug opening 50 associated with the second combustion chamber 36, and first and second spark plugs 82, 84 located in the first and second spark plug openings 52, 54 associated with the third combustion chamber 38. The first and second spark plug openings 46, 48 associated with the first combustion chamber 34 may be located between the first intake port 56 and the single exhaust port 60. Similarly, the first and second spark plug openings 52, 54 associated with the third combustion chamber 38 may be located between the first intake port 70 and the single exhaust port 74. Therefore, the first and second spark plugs 76, 78 may be in communication with the first combustion chamber 34, the single spark plug 80 may be in communication with the second combustion chamber 36, and the first and second spark plugs 82, 84 may be in communication with the third combustion chamber 38.

The valvetrain assembly 22 may include a first camshaft 86, a second camshaft 88, first intake valves 90 located in the first and second intake ports 56, 68, a first exhaust valve 92 located in the single exhaust port 60, second intake valves 94 located in the first and second intake ports 62, 64, second exhaust valves 96 located in the first and second exhaust ports 66, 68, third intake valves 98 located in the first and second intake ports 70, 72, and a third exhaust valve 100 located in the single exhaust port 74. The first camshaft 86 may form an intake camshaft and may include a first set of intake lobes 102 and a second set of intake lobes 104. The second camshaft 88 may form an exhaust camshaft and may include a first set of exhaust lobes 106 and a second set of exhaust lobes 108.

The first set of intake lobes 102 may be engaged with the first and third intake valves 90, 98 via valve lift mechanisms 110 to control opening of the first and third intake valves 90, 98. The second set of intake lobes 104 may be engaged with second intake valves 94 via valve lift mechanisms 112 to control opening of the second intake valves 94. The first set of exhaust lobes 106 may be engaged with the first and third exhaust valves 92, 100 via valve lift mechanisms 114 to control opening of the first and third exhaust valves 92, 100. The second set of exhaust lobes 108 may be engaged with the second exhaust valves 96 via valve lift mechanisms 116 to control opening of the second exhaust valves 96.

The first combustion chamber 34 may form a four-stroke operating cycle combustion chamber having one combustion event per two crankshaft revolutions. The third combustion chamber 38 may also form a four-stroke operating cycle combustion chamber having one combustion event per two crankshaft revolutions. The second combustion chamber 36 may form a two-stroke operating cycle combustion chamber having one combustion event for each crankshaft revolution.

The intake lobes from the second set of intake lobes 104 may have twice the number of peaks as the intake lobes from the first set of intake lobes 102. In the present non-limiting example, the intake lobes from the second set of intake lobes 104 may each have first and second peaks 118, 120 and the intake lobes from the first set of intake lobes 102 may each have a single peak 122. Similarly, the exhaust lobes from the second set of exhaust lobes 108 may have twice the number of peaks as the exhaust lobes from the first set of exhaust lobes 106. The exhaust lobes from the second set of exhaust lobes 108 may each have first and second peaks 124, 126 and the exhaust lobes from the first set of exhaust lobes 106 may each have a single peak 128. In the present non-limiting example, the first and second camshafts 86, 88 may rotate at one-half of the rotational speed of the crankshaft 14. Therefore, the second intake and exhaust valves 94, 96 may each be opened once per crankshaft revolution and the first intake and exhaust valves 90, 92 and the third intake and exhaust valves 98, 100 may each be opened once per two crankshaft revolutions to accommodate the multi-cycle arrangement (four-stroke and two-stroke operating cycles).

What is claimed is:

1. A cylinder head comprising:

a first intake and exhaust port arrangement defined in a cylinder head structure that provides air flow to a first combustion chamber and transports exhaust gas flow from the first combustion chamber, the first intake and exhaust port arrangement including only a single exhaust port in direct communication with the first combustion chamber;

a second intake and exhaust port arrangement defined in the cylinder head structure that provides air flow to a second combustion chamber and transports exhaust gas flow from the second combustion chamber, the second intake and exhaust port arrangement including two exhaust ports each in direct communication with the second combustion chamber so as to extend directly from a wall of the second combustion chamber; and a third intake and exhaust port arrangement defined by the cylinder head structure that provides air flow to a third combustion chamber and transports exhaust gas flow from the third combustion chamber, the third intake and exhaust port arrangement including a only single exhaust port in direct communication with the third combustion chamber, the two exhaust ports of the second intake and exhaust port arrangement being permanently connected to intake ports of the first and third intake and exhaust port arrangements to deliver all of the exhaust gasses from the second combustion chamber to the first and third combustion chambers and the single exhaust port of the first and third intake and exhaust port arrangements being exhausted to the environment without delivery to any of the combustion chambers.

2. The cylinder head of claim 1, wherein the first intake and exhaust port arrangement includes a first intake port and the single exhaust port, the cylinder head defining a first spark plug opening receiving a first spark plug and a second spark plug opening receiving a second spark plug, the first spark plug opening and the second spark plug opening being located between the first intake port and the single exhaust port and providing communication between the first and second spark plugs and the first combustion chamber.

3. The cylinder head of claim 1, wherein the second intake and exhaust port arrangement is located between the first intake and exhaust port arrangement and the third intake and exhaust port arrangement along a longitudinal extent of the cylinder head.

4. The cylinder head of claim 1, wherein the cylinder head structure defines a first spark plug opening receiving a first spark plug and a second spark plug opening receiving a second spark plug, the first and second spark plug openings providing communication between the first and second spark plugs and the first combustion chamber.

5. An engine assembly comprising:

an engine block defining a first cylinder bore and a second cylinder bore;

a first piston located in the first cylinder bore;

a second piston located in the second cylinder bore; and a cylinder head coupled to the engine block, cooperating with the first cylinder bore and the first piston to define a first combustion chamber and cooperating with the second cylinder bore and the second piston to define a second combustion chamber, the cylinder head defining a first intake and exhaust port arrangement in communication with the first combustion chamber and defining a second intake and exhaust port arrangement in communication with the second combustion chamber, the first intake and exhaust port arrangement including only a single exhaust port in direct communication with the first combustion chamber and the second intake and exhaust port arrangement including two exhaust ports in direct communication with the second combustion chamber so as to extend directly from a wall of the second combustion chamber;

further comprising a third piston located in a third cylinder bore defined by the engine block, the cylinder head cooperating with the third cylinder bore and the third piston to define a third combustion chamber and defining a third intake and exhaust port arrangement in communication with the third combustion chamber, the third intake and exhaust port arrangement including only a single exhaust port in direct communication with the third combustion chamber, the two exhaust ports of the second intake and exhaust port arrangement being permanently connected to intake ports of the first and third intake and exhaust port arrangements to deliver all of the exhaust gasses from the second combustion chamber to the first and third combustion chambers and the single exhaust port of the first and third intake and exhaust port arrangements being exhausted to the environment without delivery to any of the combustion chambers.

6. The engine assembly of claim 5, wherein the second cylinder bore is located between the first cylinder bore and the third cylinder bore along a longitudinal extent of the engine block.

7. The engine assembly of claim 5, further comprising first and second spark plugs in communication with the first combustion chamber.

8. The engine assembly of claim 5, wherein the first combustion chamber defines a four-stroke operating cycle combustion chamber and the second combustion chamber defines a two-stroke operating cycle combustion chamber.

* * * * *